US006491015B1

(12) United States Patent
Thieleke et al.

(10) Patent No.: US 6,491,015 B1
(45) Date of Patent: Dec. 10, 2002

(54) DEVICE FOR CREATING A LAMINAR FLAME FRONT

(75) Inventors: Joachim Thieleke, Wasserburg (DE); Kaveh Towfighi, Sigmarszell (DE); Iwan Wolf, Chur (CH)

(73) Assignee: Hilti Aktiengesellschaft, Schaan (LI)

( * ) Notice: Subject to any disclaimer, the term of this patent is extended or adjusted under 35 U.S.C. 154(b) by 49 days.

(21) Appl. No.: 09/684,875

(22) Filed: Oct. 6, 2000

(30) Foreign Application Priority Data

Oct. 19, 1999 (DE) ..... 199 50 351

(51) Int. Cl.[7] ..... F02B 19/06
(52) U.S. Cl. ..... 123/260; 123/46 A; 123/143 B
(58) Field of Search ..... 123/260, 267, 123/268, 280, 283, 286, 46 R, 46 A, 46 H, 37, 38, 39, 169 PH, 143 B, 169 PA, 169 P

(56) References Cited

U.S. PATENT DOCUMENTS 1,766,740 A * 6/1930 Bitchman ..... 123/169 PA
4,773,581 A * 9/1988 Ohtsu et al. ..... 123/46 SC

* cited by examiner

*Primary Examiner*—Gene Mancene
*Assistant Examiner*—Arnold Castro
(74) *Attorney, Agent, or Firm*—Sidley Austin Brown & Wood, LLP

(57) ABSTRACT

A device for creating a laminar flame front in an internal combustion-engined tool having a combustion chamber (1) with two walls (14, 18) extending parallel to each other, the device including a cage (51) located between the two walls (14, 18) and having a plurality of openings (53) formed in an otherwise solid circumferential wall of the cage (51), and an ignition element (52) located in a cage interior for igniting a combustible gas mixture located between the two walls (14, 18).

5 Claims, 7 Drawing Sheets

DEVICE FOR CREATING A LAMINAR FLAME FRONT

BACKGROUND OF THE INVENTION

1. Field of the Invention

The present invention relates to a device for creating a laminar flame front in an internal combustion-engined tool, in particular in a setting tool for setting fastening elements, including a combustion chamber with two walls extending parallel to each other and spaced from each other, with the device including an ignition element located between the two walls for igniting a combustible mixture located between the walls.

2. Description of the Prior Act

The internal combustion-engined tools, such as, e.g., setting tools for setting fastening elements, operate in accordance with Adams principle. In these tools, an ignition element is arranged between the two combustion chambers for igniting a combustible mixture, in particular an air-fuel gas mixture, an oxygen-fuel gas mixture or the like located between the two walls.

The two walls limit a fore-chamber, in which the ignition element is located, with one of the walls being provided with openings which communicate the fore-chamber with at least one further partial combustion chamber. When a further partial combustion chamber is present, it is designated as a main chamber and is adjoined by the operating piston of the setting tool. In each of the chambers, there is located an air-fuel gas mixture, possibly, with different mixing ratios. The combustion of the air-fuel gas mixture in the fore-chamber is initiated by an electrical spark produced by the ignition element, and a flame front spreads from the center of the fore-chamber, where the ignition element is usually located, with a relatively small speed, over the volume of the fore-chamber. The flame front pushes the unconsumable air-fuel gas mixture ahead of itself, and the unconsumable mixture flows, through the openings formed in one of the walls, into the adjacent further chamber creating there turbulence and pre-compression.

When the flame front propagates through the wall openings into the adjacent or main chamber, because of a small cross-section of the openings, it is accelerated and enters the adjacent chambers in a form of flame jets, creating there a further turbulence. The intermixed, due to the turbulence, air-fuel gas mixture is ignited over the entire surface of the flame jets. It burns with a high speed which results in a noticeable increase in the efficiency of the combustion, as the losses due to cooling remain small.

A drawback of the above-described process consists in that after the ignition of the air-fuel gas mixture in the fore-chamber, the formed laminar flame front spreads rather slowly. Therefore, the flame penetrates into the main chamber relatively late which reduces the efficiency of the combustion due to high cooling losses. Further, the initial pressure increase in the main chamber can result in a premature displacement of the piston though a complete ignition in the main chamber has not yet taken place.

Because of this, the air-fuel gas mixture in the main chamber becomes decompressed and is cooled off, which further reduces the efficiency of the combustion.

Accordingly, an object of the present invention is to provide a device which would permit to obtain a more rapid propagation of the flame front.

SUMMARY OF THE INVENTION

This and other objects of the present invention, which will become apparent hereinafter, are achieved by providing, between the combustion chamber walls, a cage for receiving the ignition element and which has, in an otherwise closed circumferential wall thereof, a plurality of openings extending parallel to the combustion chamber walls.

It has been found out that when the ignition element is surrounded by a cage, the spreading of the flame front after the ignition takes place only through the openings, which permits to obtain, already in the fore-chamber, a high flame spreading speed. Thereby, the flame penetrate into the main chamber more rapidly. This increases the combustion efficiency due to the smaller cooling losses. In addition, the observation has shown that the flame front after exiting the openings of the cage becomes again closed so that, it practically, reaches all of the openings in the combustion chamber wall which are equidistantly spaced from the ignition element, simultaneously.

Preferably, the openings, which are formed in the cylindrical wall of the cage, are equidistantly angularity spaced from each other. This provides for a symmetrical spreading of the flame front.

The cage itself can be formed as a hollow cylinder a longitudinal axis of which extends transverse to the combustion chamber walls. The cage forms part of a lug fixedly connected with one of the walls and sealingly extending through an opening formed in another of the walls.

The two combustion chamber walls can be made displaceable relative to each other and can lie on one another to provide for evacuation of the exhaust gas accumulated there between. Usually, both walls have a circular shape and are arranged coaxially with respect to the central longitudinal axis of the cage.

According to one embodiment of the present invention, the adjacent wall portions of the adjacent openings butt-join each other, forming common edges. This insures that the flame front, which propagates parallel to the combustion chamber walls, would never strike any portion of a cage wall that extends transverse to the spreading direction of the flame front. Thereby, a conversion of the flame front speed in an undesirable turbulence is prevented.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiments, when read with reference to the accompanying drawings.

DETAILED DESCRIPTION OF THE PREFERRED EMBODIMENT

Figure 1:
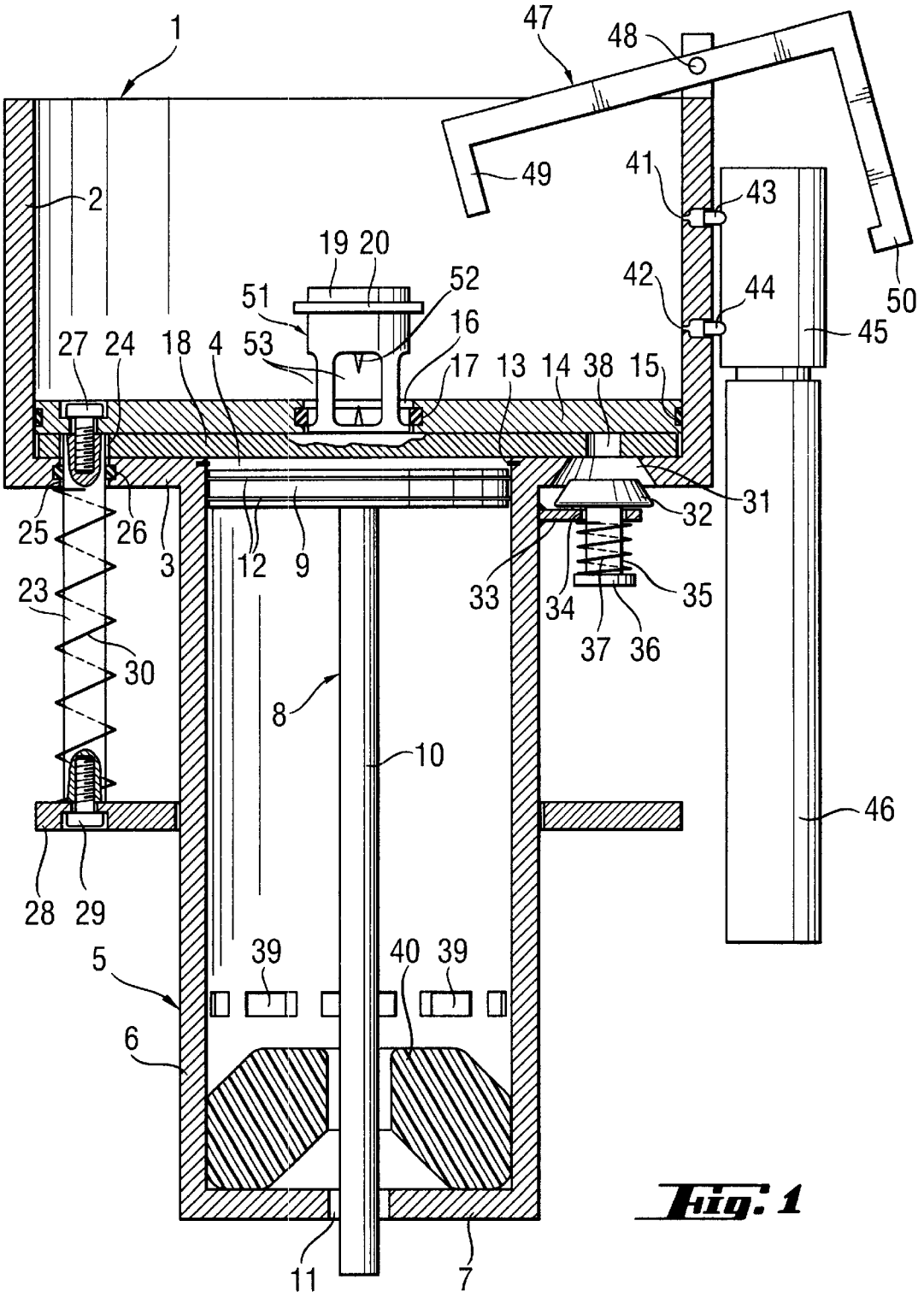
FIG. 1 an axial cross-sectional view of an internal combustion-engined tool with a collapsed combustion chamber.

FIG. 1 shows a cross-sectional view of an internal combustion engined-setting tool for setting fastening elements in the region of the tool combustion chamber. As shown in FIG. 1, the setting tool has a cylindrical combustion chamber 1 with a cylindrical wall 2 and an annular bottom 3 with a central opening 4. A guide cylinder 5, which has a cylindrical wall 6 and a bottom 7, adjoins the opening 4 in the bottom 3 of the combustion chamber 1. A piston 8 is displaceably arranged in the guide cylinder 5. The piston 8 consists of a piston plate 9 facing the combustion chamber 1 and a piston rod 10 extending from the center of the piston plate 9. The piston rod 10 projects through an opening 11 formed in the bottom 7 of the guide cylinder 5.

FIG. 1 shows a non-operational position of the setting tool in which the piston 8 is in its rearward off-position. The side of the piston plate 9 adjacent to the bottom 3 of the combustion chamber 1 is located closely adjacent to the bottom 3, with the piston rod 10 projecting only slightly beyond the bottom 7 of the guide cylinder 5. For sealing the cylinder chambers on opposite sides of the piston plate 9 from each other, sealing rings 12, 13 are provided on the outer circumference of the piston plate 9.

Inside of the combustion chamber 1, there is provided a cylindrical plate 14 further to be called a movable combustion chamber wall or movable wall. The movable wall 14 is displaceable in the longitudinal direction of the combustion chamber 1. For separating the chambers on opposite sides of the movable wall 14, an annular sealing 15 is provided on the circumference of the movable wall 14. The movable wall 14 has a central opening 16, with an annular sealing 17 provided in the wall of the opening 16.

Between the movable wall 14 and the annular bottom 3 of the combustion chamber 1, there is provided a separation plate 18. The separation plate 18 has a circular shape and an outer diameter corresponding to the inner diameter of the combustion chamber. The side of the separation plate 18 adjacent to the movable wall 14 is provided with a cylindrical lug 19 that projects through the central opening 16 in the movable wall 14. The length of the lug 19 exceeds the thickness of the movable wall 14 in several times. The circumferential or annular sealing 17 sealingly engages the outer circumference of the cylindrical lug 19. At its free end, the cylindrical lug 19 is provided with a shoulder 20 the outer diameter of which exceeds the outer diameter of the lug 19 and the inner diameter of the opening 16 of the movable wall 14. Thus, upon moving away from the bottom 3 of the combustion chamber 1, the movable wall 14, in a while, engages the shoulder 20 of the lug 19 and lifts the separation plate 18 with it. Thus, the movable wall 14 and the separation plate 15 become spaced a predetermined distance which is determined by the position of the shoulder 20. In this way, the movable wall 14 and the separation plate 18 form a so called fore-chamber, which forms a partial combustion chamber of the combustion chamber 1. The fore-chamber is designated with a reference numeral 21 and is clearly shown in FIG. 2. After the movable wall 14 engages the shoulder 20, the movable wall 14 and the separation plate 18 are displaced together, and a further partial combustion chamber is formed between the separation plate 18 and the bottom 3 and/or the piston plate 9. This further chamber forms a main chamber. It is designated with a reference numeral 22 and is likewise clearly shown in FIG. 2.

For displacing the movable wall 14, there are provided several, e.g., three drive rods 23 uniformly distributed along the circumference of the movable wall 14 and fixedly connected therewith. Only one of the drive rods 23 is shown in FIG. 1. The drive rods 23 extend parallel to the axis of the combustion chamber 1 and outside of the cylindrical wall 6 of the guide cylinder 5. The drive rods 23 extend through openings 24, respectively, formed in the separation plate 18 and through corresponding openings 25 formed in the bottom 3 of the combustion chamber 1. Each of the openings 25 is provided with a circumferential seal 26 located in the surface defining the opening 25 for sealing the combustion chamber 1 from outside. The movable wall 14 is connected with drive rods 23 by, e.g., screws 27 which extend through the movable wall 14 and are screwed into the drive rods 23. The free ends of the drive rods 23 are connected with each other by a drive ring 28 which is arranged concentrically with the combustion chamber axis and which circumscribes the guide cylinder 5. The drive ring 28 is connected with the drive rods 23 by screws 29 which extend through the drive ring 28 and are screwed into the drive rods 23 through end surfaces of the free ends of respective drive rods 23. Each of the drive rods 23 supports a compression spring 30 extending between the bottom 3 of the combustion chamber 1 and the drive ring 28. The compression springs 30 are designed for pulling the movable wall 14 toward the bottom 3.

In the region of the bottom of the combustion chamber, there is further provided a ventilation opening 31 into which a valve tappet 32 is sealingly extendable. With the ventilation opening 31 being open, the valve tappet 32 is located outside of the combustion chamber 1 or beneath the bottom 3 of the combustion chamber 1. The valve tappet 32 is supported outside of the combustion chamber 1 by a shoulder 33 secured on the guide cylinder 5. The shoulder 33 has an opening 34 through which a stub 35, which is secured to the bottom side of the valve tappet 32, extends. At the free end of the stub 35, there is provided a shoulder 36, and a compression spring 37 is arranged between the shoulder 36 and the shoulder 33. The compression spring 37 is designed for pulling the valve tappet 32 toward the shoulder 33 to keep the ventilation opening 31 open. The cylindrical stub 35 lies in the displacement path of the drive ring 28 and is impacted by the drive ring 28 when the later is displaced toward the bottom 3 of the combustion chamber 1. At a predetermined axial position, the drive ring 28 engages the stub 35 pushing it upward, so that the valve tappet 32 closes the ventilation opening 31.

A plurality of further openings 38 are distributed over the circumference of the separation plate 18 at the same distance from the combustion chamber axis. In the lower end of the guide cylinder 5, there are formed a plurality of outlet openings 39 for evacuating air from the guide cylinder 5 when the piston 8 is displaced toward the bottom 7 of the guide cylinder 5. At the lower end of the guide cylinder 5, there is provided damping means 40 for damping the movement of the piston 8. When the piston 8 passes past the openings 39, an exhaust gas can escape through the openings 39.

Two radial, axially spaced openings 41 and 42 are formed in the cylindrical wall 2 of the combustion chamber 1. Two outlet nipples 43, 44 extend into the radial openings 41, 42, respectively, from outside. The nipples 43, 44 form part of metering valves (not shown in detail) of a metering head 45. A liquefied fuel gas is delivered to metering valves located in the metering head 45 from a bottle 46. The metering valves provide for flow of a predetermined amount of the liquefied fuel gas through the outlet nipples 43, 44 when the metering head 45 is pressed against the cylindrical wall 2 of the combustion chamber 1, and the outlet nipples 43, 44 are pushed inward, opening the respective metering valves. To provide for the inward movement of the outlet nipples 43, 44, the radial openings 41, 42 narrow toward the interior of the combustion chamber 1, providing stops for the outlet nipples 43, 44. The pressing of the metering head 45 against the cylindrical wall 2 is effected with a stirrup 47 pivotable at a hinge point 48 on the cylindrical wall 2. One end 49 of the stirrup 47 is impacted by the movable wall 14, and the stirrup is pivoted in such a way that its another end 50 is pressed against the metering head 45 to press the later toward the cylindrical wall 2. The movable wall 14 engages the end 49 of the stirrup 47 shortly before the partial chamber 21 reaches its end position. The metering head 45 and the bottle 46, once connected with each other, remain permanently connected. The system 45/46 can, e.g., tilt about an axle provided in the bottom region of the bottle 46.

Figure 2:
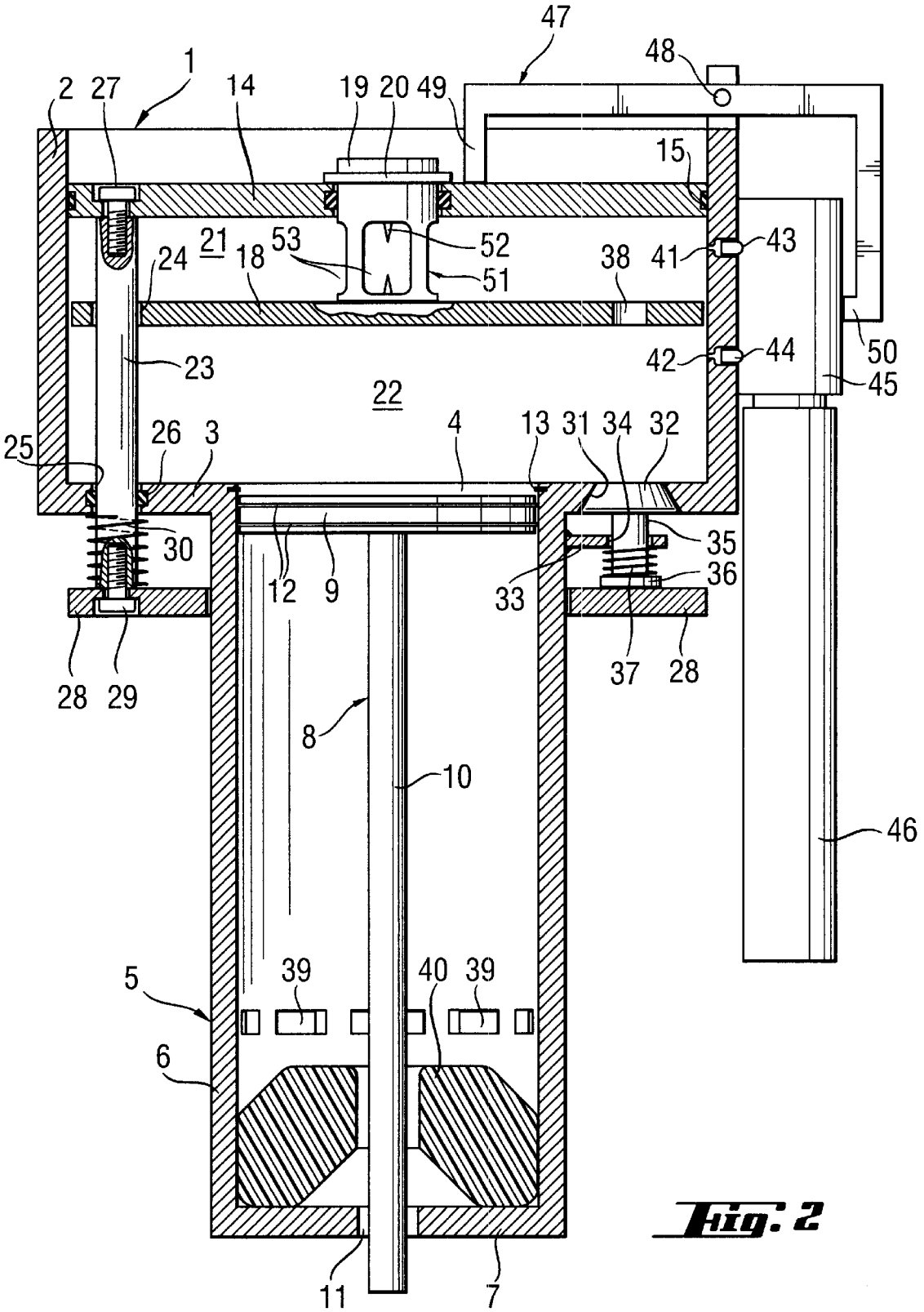
FIG. 2 an axial cross-sectional view of the tool shown in FIG. 1 with an expanded combustion chamber.

FIG. 2 shows the setting tool with the combustion chamber 1 in its expanded condition, i.e., with the expanded fore-chamber 21 and main chamber 22. The displaced positions of the movable wall 14 and the separation plate 18 are established when the driving ring 28 impacts the shoulder 36, closing the valve 31, 32. The opening 31 and the valve tappet 32 have conical circumferential surfaces narrowing in the direction of the combustion chamber 1, so that a stop is formed. As it has been discussed previously, the distance of the separation plate 18 from the movable wall 14 is determined by the distance of the shoulder 20 from the separation plate 18. In this position of the movable wall 14 and the separation plate 18, the radial openings 41, 42 lie against the fore-chamber 21 and the main chamber 22, respectively.

The lug 19 forms, in its region adjacent to the separation plate 18, an ignition cage 51 for receiving an ignition element 52. The ignition element 52 serves for generating an electrical spark for the ignition of the air-fuel gas mixture in the fore-chamber 21. As it will be described in more detail below, the ignition device 52 is located in the central region of the cage 51 having openings 53 formed in the cage circumference. Through this openings 53, a laminar flame front exit from the ignition cage 51 into the fore-chamber.

Below, the operation of the setting tool, shown in FIGS. 1–2, will be described in detail.

FIG. 1 shows the condition of the combustion chamber 1 in the off-position of the setting tool. The combustion chamber 1 is completely collapsed, with the separation plate lying on the bottom 3 of the combustion chamber 1 and the movable wall 14 lying on the separation plate 18. The piston 8 is in its rearward off-position so that practically no space remains between the piston 8 and the separation plate 18 if one would disregard a small clearance there-between. The position, in which the movable wall 14 lies on the separation plate 18, results from the compressing spring 30 biasing the drive ring 28 away from the bottom 3, and the ring 28 pulls with it the movable wall 14 via the drive rods 23. In this position, the drive ring 28 is spaced from the shoulder 36 of the valve tappent 32, and the compression spring 37 keeps the valve tappet 32 outside of the opening 31 so that the opening 31 remains open. The system metering head 45/bottle 46 is pivoted away from the wall 2 of the combustion chamber 1, with the outlet nipples 43, 44 being released and the metering valve (no shown) being open.

When in this condition, the setting tool is pressed with its front point against an object, the fastening element should be driven in. A mechanism, not shown, applies pressure to the drive ring 28 displacing it in the direction of the bottom 3 of the combustion chamber 1. This takes place simultaneously with the setting tool being pressed against the object. Upon displacement of the drive ring 28 toward the bottom 3, the movable wall 14 is lifted of the separation plate 18 and, after engaging the shoulder 20, lifts the separation plate 18 with it. Upon engagement of the shoulder 20 by the movable wall 14, the fore-chamber 21 is completely expanded but does not yet occupy its operational position inside the combustion chamber 1. During the expansion of the fore-chamber 21, the air can already been aspirated into the fore-chamber 21 through the ventilation opening 31 and through one or more of openings 38 formed in the separation plate 18 and overlapping the ventilation opening 31.

Upon the setting tool being further pressed against the object, the drive ring 28 is moved closer to the bottom 3, and the movable wall 14 is moved further upward, lifting the separation plate 18 from the bottom 3. As a result, the main chamber 22 likewise expands and is aerated through the ventilation opening 31, with the fore-chamber 21 being aerated through all of the openings 38.

When the movable wall 14 and the separation plate 18, in their movement upward, move past the radial openings 41, 42, in principle, the injection of metered amounts of liquefied fuel gas into the fore-chamber 21 and the main chamber 22 can begin. The injection starts when the movable wall engages the end 49 of the stirrup 47 which pivots in a clockwise direction about the pivot point 48, with the other stirrup end 50 pressing the metering head 45 toward the cylindrical wall 2. Upon the metering head 45 being pressed against the cylindrical wall 2, the outlet nipples 43, 44 move inward, opening the respective metering valves. The liquefied gas is injected into the fore-chamber 21 and the main chamber 22. Thereafter, a further lifting of the movable wall 14 and the separation wall 18 is necessary to bring them into their end positions in which they are locked. The possible residual pivotal movement of the stirrup 27 is compensated by the outlet nipples 43, 44 being moved a small distance further inward into the metering head 45.

In the last part of the displacement of the moving wall 14 and the separation plate 18 to their end positions, the valve tappet 2 is pushed into the opening 31, closing the same, as a result of the drive ring 28 engaging the shoulder 36.

The positions of the movable wall 14 and the separation plate 18 in the completely expanded condition of the fore-chamber 21 and the main chamber 22 is shown in FIG. 2. In these positions, the movable wall 14 and the separation plate 18 can be locked. The locking takes place upon actuation of an appropriate lever or trigger of the setting tool. Upon actuation of the trigger, the movable wall 14 and the separation plate 18 become locked. The locking of the separation plate 18 and the movable wall 14 can be effected by locking of the drive ring 28. Shortly after the locking of the movable wall 14 and the separation plate 18, a ignition spark is generated by the actuation of the ignition element 52 inside the cage 51. A mixture of air and the fuel gas, which was formed in each of the chambers 21 and 22, is ignited. First, the mixture starts to burn luminary in the fore-chamber 21, and the flame front spreads rather slowly in a direction of the openings 38. The unconsumable air-fuel gas mixture is displaced ahead and enters, through the openings 38, the main chamber 22, creating there turbulence and pre-compression. When the flame front reaches the openings 38, it enters the main chamber 22, due to the reduced cross-section of the openings 38, in the form of flame jets, creating there a further turbulence. The thoroughly mixed, turbulent air-fuel gas mixture in the main chamber 22 is ignited over the entire surface of the flame jets. It burns with a high speed which significally increases the combustion efficiency.

The combustible mixture impacts the piston 8, which moves with a high speed toward the bottom 7 of the guide cylinder 5, forcing the air from the guide cylinder 5 out through the openings 39. Upon the piston plate 9 passing the openings 39, the exhaust gas is discharged therethrough. The piston rod 10 effects setting of the fastening element. After setting or following the combustion of the air-fuel gas mixture, the piston 8 is brought to its initial position, which is shown in FIG. 2, as a result of thermal feedback produced by cooling of the flue gases which remain in the combustion chamber 1 and the guide cylinder 5. As a result of cooling of the flue gases, an underpressure is created behind the piston 8 which provides for return of the piston 8 to its initial position. The combustion chamber 1 should remain sealed until the piston 8 reaches its initial position.

After return of the piston 8 to its initial position, the movable wall 14 and the separation plate 18 are unlocked. The compression springs 30 bias the drive ring 28 away from the bottom 3 of the combustion chamber 1, and the drive ring 28 releases the valve tappet 32, and the compression spring 39 pushes the valve tappet 32 out of the opening 31, opening same. Upon being displaced away from the bottom 3 by the compression springs 30, the drive ring 28 pulls the movable wall 14 with it toward the bottom 3. Later, as the drive ring 28 moves further away from the bottom 3, the movable wall 14 abuts the separation plate 18, pushing it toward the bottom 3. Upon movement of the movable wall 14 and the separation plate 18 toward the bottom 3, the exhaust gases in the fore-chamber 21 are pushed through the openings 38 in the separation plate 18 into the main chamber 22 and therefrom, together with the exhaust gases formed in the main chamber 22, through the opening 31 outside. Finally, the separation plate 18 lies again on the bottom 3, and the movable wall 14 lies on the separation plate 18. The combustion chamber 1 becomes completely collapsed and free of exhaust gases. The aeration process can start again.

Figure 3:
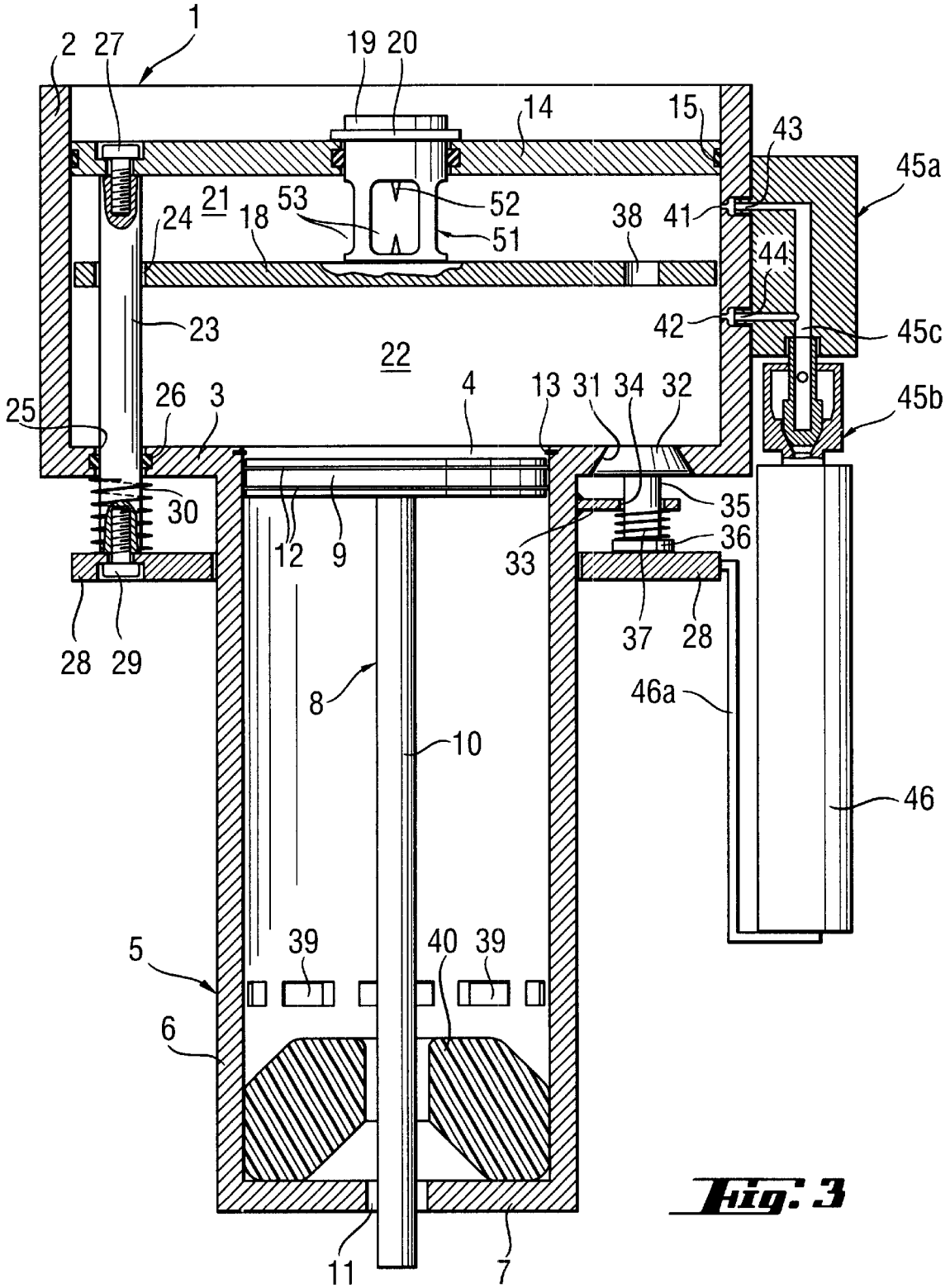
FIG. 3 an axial cross-sectional view of the tool shown in FIG. 1 with an expanded combustion chamber with a modified actuation mechanism for delivery of fuel gas.

FIG. 3 shows, in principle, the same arrangement as FIGS. 1–2 and, therefore, a detailed description of it is not necessary. The arrangement of FIG. 3 differs from that of FIGS. 1–2 in that the system metering head 45*a*/bottle 46 is not tiltable but rather the system metering value 45*b*/bottle 46 is displaceable in the longitudinal direction of the combustion chamber 1. To this end, a driver 46*a* connects the bottle 46 with the drive ring 28 in the last portion of the displacement path of the drive ring 28 in the direction in which the displacement of the driving 28 results in the expansion of the combustion chamber 1.

In the arrangement shown in FIG. 3, the metering head 45*a* is fixedly connected wit the combustion chamber 1 and has two outlet nipples 43, 44 extending from a delivery channel 45*c* and connected with the radial openings 41, 42. The metering valve 45*b* is fixed by secured on the bottle 46 and is supplied with a fuel gas therefrom. When the driver 46*a* engages the bottle 46 in the last portion of the displacement path of the drive ring 28, it lifts the bottle 46, together with the metering value 45*b*, and the metering valve 45*b* is pushed against the metering head 45*a* and becomes open. The flue gas flows toward the radial openings 41, 42 and is ejected therefrom in a form of a mist. To provide for different amount of the air-fuel gas mixture in the fore-chamber 21 and the main chamber 22, the openings 41, 42 can have different outlet cross-sections or be provided with corresponding nozzles.

The arrangement shown in FIG. 4 is again substantially corresponds to the arrangement shown in FIGS. 1–2 and again does not require a detailed explanation. The arrangement of FIG. 4 differs from that of FIGS. 1–2 in that the valve tappet 32 is permanently biased into the opening 31 by the compression spring 37, closing the opening 31. To this end, the compression spring 37 is supported on the cylindrical stub 35 and against the bottom side of the valve tappet 32 and the shoulder 33 secured to the guide cylinder 5. The stub 35 extends through the opening 34 in the shoulder 33. Thus, the valve 31/32 is formed as a pure ventilation valve.

The aeration valve is designated with a reference numeral 54 and is located in the movable wall 14. When upon the displacement of the movable wall 14 and the separation wall 18, the fore-chamber 21 and the main chamber 22 expand, the ventilation valve 31/32 remain closed, and the aeration valve 54 remains open as a result of underpressure in the chambers 21 and 22. The air enters the chambers 21, 22 through the ventilation valve 54. Otherwise, the process remains the same as described above. The aeration valve 54 is formed as a return valve that must be kept closed in its initial position by an appropriate mechanism during the return stroke of the piston 8. This is achieved, e.g., by providing the movable wall 14 with a boss 55 which is sealingly inserted in the opening 56 formed in a cover wall 54 of the combustion chamber 1. Thereby, the return valve 54 is closed by the cover wall 57 when underpressure is created in the interior of the combustion chamber 1 for enabling return of the piston 8 in its initial position.

The return valve 54 remains closed when the air-fuel gas mixture in the combustion chamber 1 is ignited. The ventilation valve 31/32 likewise remain closed as the drive ring 28 abuts the stud 35 from beneath, preventing the movement of the valve tappet 32 out of the opening 31. Only, after the unlocking of the drive ring 28, the drive ring 28 can move away from the bottom 3, pulling with it the movable wall 14 and the separation plate 18, and the exhaust gases are vented outwardly through the value 31/32 which opens under the pressure of the exhaust gases.

Figure 4:
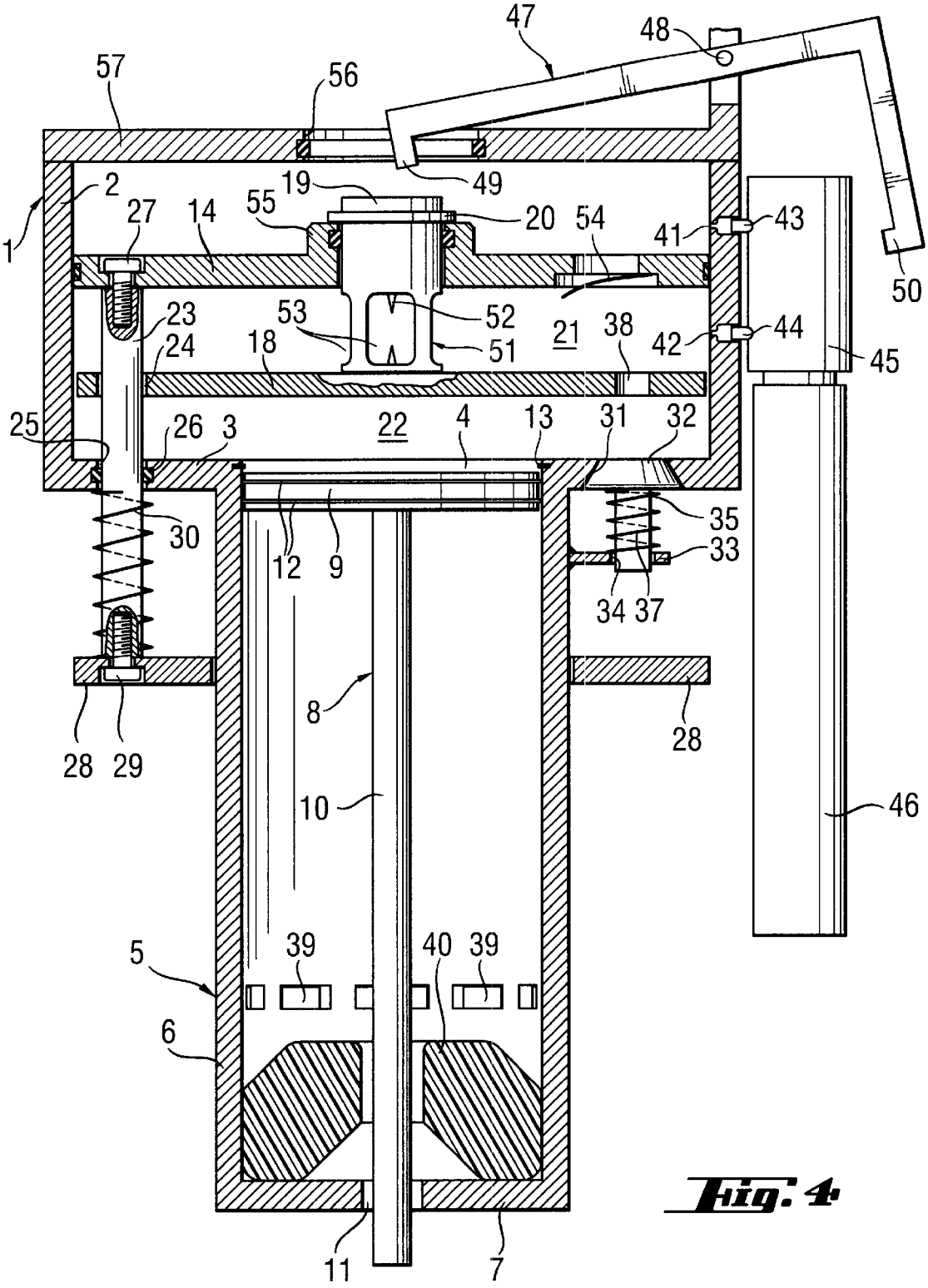
FIG. 4 an axial cross-sectional view of the tool shown in FIG. 1 with a partially expanded combustion chamber and a modified aeration device.
Figure 5:
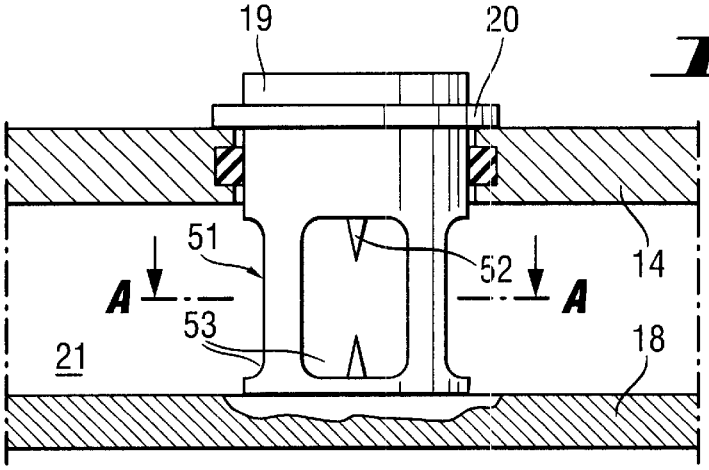
FIG. 5 a side view of an ignition device of the combustion chamber shown in FIGS. 1 through 4.
Figure 6:
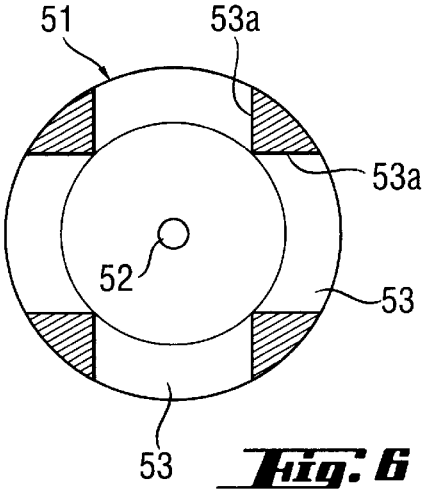
FIG. 6 a cross-sectional view along line A—A in FIG. 5.
Figure 7:
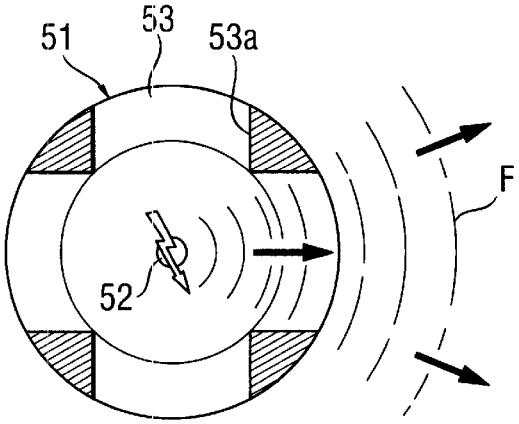
FIG. 7 a cross-sectional view along line A—A in FIG. 5 at ignition.
Figure 8:
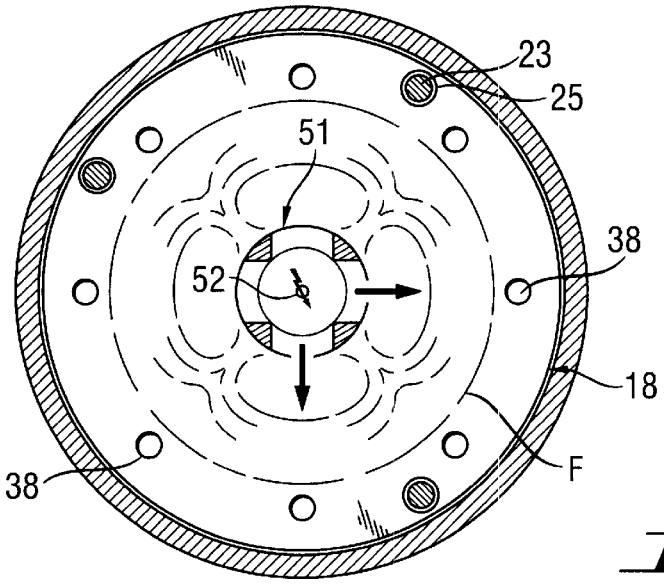
FIG. 8 a plan view of a separation plate of the combustion chamber at ignition.
Figure 9:
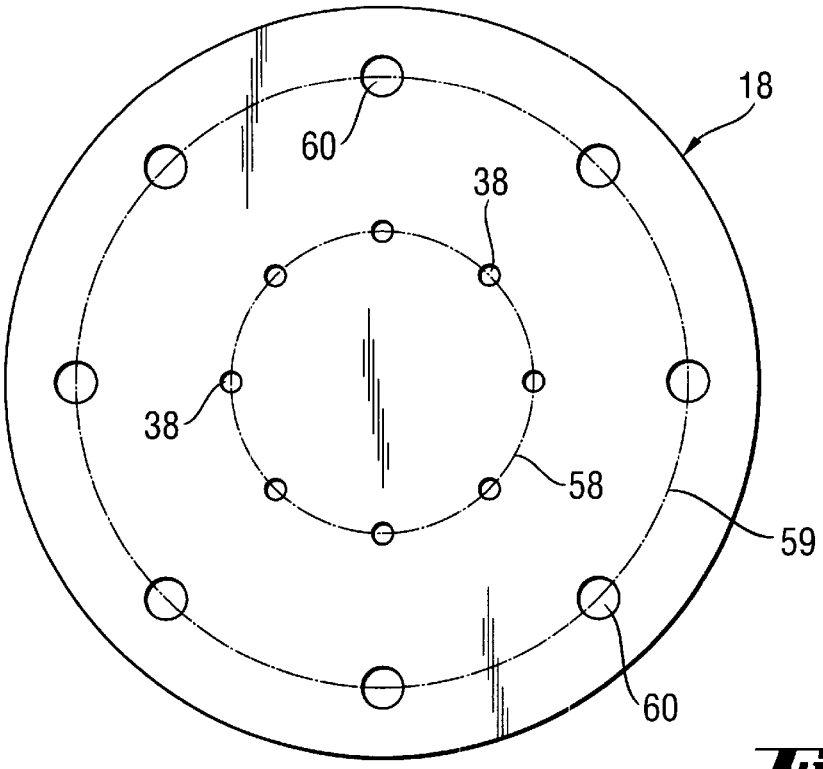
FIG. 9 a plan view of another embodiment of a separation plate of the combustion chamber.
Figure 10:
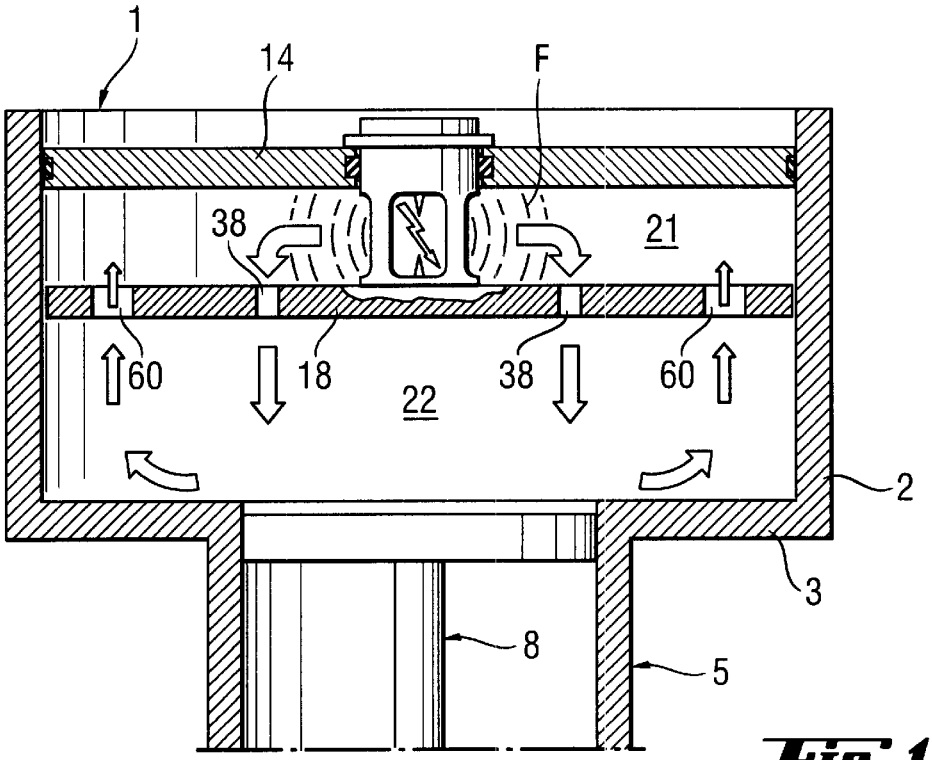
FIG. 10 an axial cross-sectional view of the tool in the region of the combustion chamber provided with a separation plate shown in FIG. 9.

FIG. 5 shows the structure of the ignition cage 51. In the expanded condition of the fore-chamber 21, the cage 51 is located between the movable wall 14 and the separation plate 18, as shown in FIG. 5. The ignition cage has a cylindrical shape with a hollow space inside in which the ignition element 52 is located. In the shown embodiment of the cage, the cylindrical wall of the cage 51 has four openings 53 having a somewhat elongated shape and a longitudinal extent of which is transverse to the movable wall 14 and the separation plate 18. Each opening 53 is defined by respective opposite surfaces 53*a*, and the width of the openings 53, at least in their middle region, is such that adjacent wall surfaces 53*a* of adjacent openings 53 form a right angle with each other. In this way, the flame front, which spreads from the center of the ignition cage 51 parallel to the movable wall 14 and the separation plate 18, can never strike an inner wall surface of the cage that extends transverse to the spreading direction of the flame front. The advantage of this consists in that the flame front is never reflected back to the cage center. This is also favorable for a better laminar flow outside the cage which becomes gradually restored shortly after the flame front leaves the cage 51. The arrangement of the openings 53 and flame propagation are shown in FIGS. 6–8. In particular FIG. 8 shows a plan view of the separation plate 18 and a cross-sectional view of the cage 51 taken parallel to the separation plate 18. The flame front F becomes again laminar when it reaches the openings 38 of the separation plate 18. As an ignition element 52, e.g., a spark plug can be used. Another embodiment of the setting tool according to the present invention is shown in FIGS. 9–10. In this embodiment, the separation plate 18 has two rows of openings. The separation plate 18 has a circular shape, and the two rows are arranged concentrically with respect to the separation plate center. The inner openings 38 form the inner row 58 and have a relatively small diameter. The return flow openings 60 form the second, outer row 59 and have a diameter somewhat greater than that of openings 38. The remaining structure is similar to that of FIGS. 1–4.

Provision of two rows of openings 58 and 59 accelerates ignition of the air-fuel gas mixture in the main chamber 22 and generally improves efficiency of the combustion process.

As it has already been discussed above, after the ignition of the air-fuel gas mixture in the fore-chamber 21, a laminar flame front F is formed. The flame front F spreads relatively slow to the circumferential edge of the fore-chamber 21. This flame front reaches the first row 58 of the openings 38 very quickly and provides for ignition in the main chamber 22. The position of the first row 58 of the opening 38 is so selected that only that volume of the air-fuel gas mixture is burned in the fore-chamber 21, which is necessary for forming of flame jets with a predetermined energy necessary to produce a sufficient turbulence in the main chamber 22 when the flame jets penetrate through the openings 38 into the main chamber 22. The turbulent combustion in the main chamber 22 causes a flow of a portion of the unconsumable gases from the main chamber 22 back through the second row 59 of the openings 60 into side regions of the fore-chamber 21. The air-fuel gas mixture in the side regions of the fore-chamber 21 burns likewise turbulently and simultaneously with the combustion process in the main chamber 22. This insured that the combustion in the side regions of the fore-chamber 21 also contributes to the operation of the piston 8.

In a particular embodiment of the present invention, the diameters of the first and second rows 58 and 59 constitute, respectively, 55% and 85% of the diameter of the separation plate 18. The diameters of the openings 38 and the openings 60 constitute, respectively, 2.6% and 3.8% of the diameter of the separation plate 18.

Figure 11:
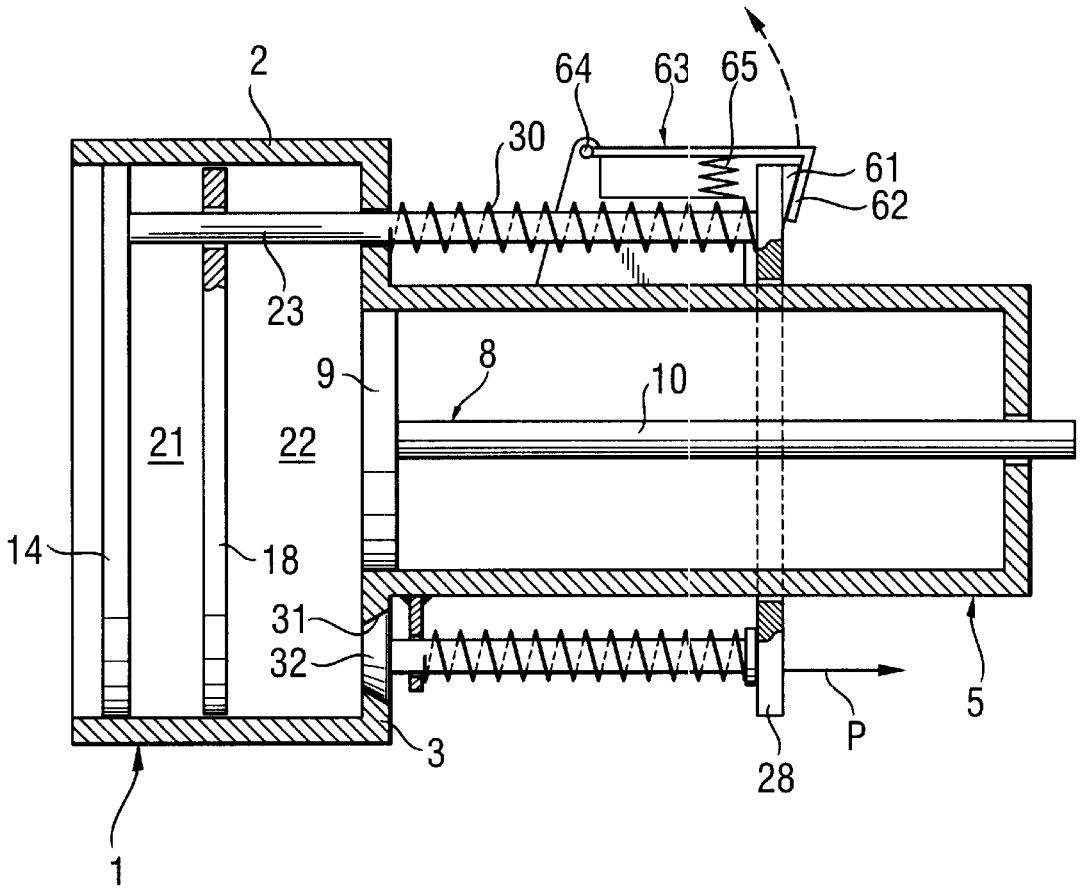
FIG. 11 a longitudinal view of a tool in the region of the combustion chamber with the combustion chamber being closed.

FIG. 11 shows the locking arrangement of the combustion chamber in a setting tool in which the return displacement of the piston is caused by created thermal conditions. In FIG. 11, the like elements are designated with the same reference numerals as in FIGS. 1–4.

As shown in FIG. 11, a contact member 61 is provided on the circumference of the drive ring 28. The contact member 61 has a stop surface extending in the direction toward the front end of the setting tool. This stop surface is inclined, and the inclination is such that it tapers outwardly toward the front end of the setting tool. Parallel to this surface, in the path of the contact member 61, there is located a blocking section 62 of a blocking member 63. The blocking member 63 so pivots about a pivot axis 64 that it can pivot out of the displacement path of the contact member 61 by a spring 65. The displacement path of the contact member 61 extends parallel to the piston rod 10.

In FIG. 11, the fore-chamber 21 and the main chamber 22 are completely expanded and are filled with an air-fuel gas mixture. Upon actuation of the trigger, the combustion chamber 1 is locked by the arm-shaped blocking member 63, and the combustion is initiated in the combustion chamber 1. The forces that act on the movable wall 14 in the underpressure phase, are transmitted through the drive rods 23 to the drive ring 28 and provide for displacement of the drive ring 28 in the direction of arrow P. The angle between the surface of the contact member 61 and the blocking section 62 of the blocking member 63 is so selected that the locking force acting on the drive ring 28 is directly proportional to the force acting on the movable wall 14 or the drive rods 23 as a result of underpressure, i.e., the greater is the force acting on the movable wall 14 the greater is the locking force applied to or acting on the drive ring 28. Only when the underpressure tapers off, i.e., when the piston 8 occupies its rearward initial position, the blocking section 62 can be disengaged from the contact member 61 by the restoring spring 65. Only then, the compression spring 30 provides for collapsing of the combustion chamber 1 and opening of the ventilation value 31/32, as shown in FIGS. 1 and 4. In the example discussed above, a pressure-controlled unlocking of the combustion chamber 1 takes place because the displacement path of the contact member 61 becomes free only after the drop of underpressure in the combustion chamber 1. Therefore, no additional pulling means is necessary for delaying collapse of the combustion chamber 1 and/or opening of an inlet/outlet valve until the piston returns to its initial position. The time of the collapse of the combustion chamber is self-controlled, i.e., the collapse takes place always only then when the underpressure in the combustion chamber 1 become balanced, and independently of tool temperature. The piston itself always completely returns to its rearward, initial position.

Though the present invention was shown and described with references to the preferred embodiments, such are embodiments, such are merely illustrative of the present invention and are not to be construed as a limitation thereof and various modifications of the present invention will be apparent to those skilled in the art. It is therefore not intended that the present invention be limited to the disclosed embodiments or details thereof, and the present invention includes all variations and/or alternative embodiments within the spirit and scope of the present invention as defined b the appended claims.

What is claimed is:

1. A device for creating a laminar flame front in a internal combustion engined tool having a combustion chamber (1) with two walls (14, 18) extending parallel to each other and spaced from each other in an operational position of the tool, the device comprising a cage (51) located between the two walls (14, 18) in the operational position of the tool and having a plurality of openings (53) formed in an otherwise solid circumferential wall of the cage (51); and ignition means (52) located in a cage interior for igniting a combustible gas mixture located between the two walls (14, 18), wherein one of the wall (18) is fixedly connected with the cage (51) and has a number of opening (38) spaced from the cage (51).

2. A device for creating a laminar flame front in a internal combustion engined tool having a combustion chamber (1) with two walls (14, 18) extending parallel to each other and spaced from each other in an operational position of the tool, the device comprising a cage (51) located between the two walls (14, 18) in the operational position of the tool and having a plurality of openings (53) formed in an otherwise solid circumferential wall of the cage (51); and ignition means (52) located in a cage interior for igniting a combustible gas mixture located between the two walls (14, 18), wherein the cage (51) forms part of lug (19) fixedly connected with one of the walls (18) and sealingly extending through an opening formed in another of the walls (14).

3. A device according to claim 2, wherein the openings (53) are equidistantly angularity spaced from each other.

4. A device according to claim 2, wherein the cage (51) is formed as a hollow cylinder, a longitudinal axis of which extends transverse to the combustion chamber walls (14, 18).

5. A device according to claim 2, wherein the circumferential wall of the cage (51) has a plurality of wall portions **(53*a*) defining respective openings (53), and wherein wall portions (53*a*) of the cage wall defining adjacent openings (53)** are butt-joined with each other.

* * * * *